US008870012B2

(12) United States Patent
Stengel, Jr.

(10) Patent No.: US 8,870,012 B2
(45) Date of Patent: Oct. 28, 2014

(54) FLIP-UP POP-TOP CAN LID

(76) Inventor: Gilbert P. Stengel, Jr., Burlington, KY (US)

( * ) Notice: Subject to any disclaimer, the term of this patent is extended or adjusted under 35 U.S.C. 154(b) by 1009 days.

(21) Appl. No.: 12/246,124

(22) Filed: Oct. 6, 2008

(65) Prior Publication Data

US 2009/0090716 A1 Apr. 9, 2009

Related U.S. Application Data

(60) Provisional application No. 60/977,666, filed on Oct. 5, 2007, provisional application No. 60/992,706, filed on Dec. 5, 2007.

(51) Int. Cl.
*B65D 17/34* (2006.01)
*B65D 17/00* (2006.01)

(52) U.S. Cl.
CPC ..... *B65D 17/165* (2013.01); *B65D 2517/0016* (2013.01)
USPC ..... 220/269; 220/270; 220/271; 220/272; 220/273

(58) Field of Classification Search
CPC ..... B65D 17/165; B65D 2517/0016
USPC ..... 220/269, 270, 906, 271, 272, 273; 29/700; 413/14, 16, 12; 81/3.41, 3.55; 7/151
See application file for complete search history.

(56) References Cited

U.S. PATENT DOCUMENTS

| | | | | |
|---|---|---|---|---|
| 2,565,699 | A * | 8/1951 | Rieke | 222/529 |
| 3,285,467 | A | 11/1966 | Moran | |
| 3,434,623 | A * | 3/1969 | Cookson | 220/270 |
| 3,563,199 | A | 2/1971 | Wolfe | |
| 3,762,597 | A * | 10/1973 | Kaminski et al. | 220/270 |
| 3,826,401 | A * | 7/1974 | Zundel | 220/277 |
| 3,843,011 | A * | 10/1974 | Perry | 220/260 |
| 3,853,242 | A * | 12/1974 | Zundel | 220/267 |
| 3,980,201 | A | 9/1976 | Keiji | |
| 4,141,464 | A * | 2/1979 | Kelley et al. | 220/267 |
| 4,257,529 | A | 3/1981 | Saunders | |
| 4,289,250 | A | 9/1981 | Jordan | |
| 4,485,935 | A | 12/1984 | Stoffel | |
| 4,524,646 | A | 6/1985 | Kimberlin, Jr. | |
| 5,535,911 | A | 7/1996 | Cortez | |
| 5,555,778 | A | 9/1996 | Otters et al. | |
| 6,685,417 | B2 | 2/2004 | Heinicke et al. | |

* cited by examiner

*Primary Examiner* — Andrew Perreault
*Assistant Examiner* — James M Van Buskirk
(74) *Attorney, Agent, or Firm* — Jenei LLC

(57) ABSTRACT

The present invention is a flip-up pop-tab in which a partially detachable portion of a lid of a can is separated from the can and hinged away from the opening created in the lid.

12 Claims, 5 Drawing Sheets

FLIP-UP POP-TOP CAN LID

CROSS-REFERENCE TO RELATED APPLICATION

The present application claims priority to U.S. Provisional Patent Application No. 60/977,666 as filed Oct. 5, 2007, and to U.S. Provisional Patent Application No. 60/922,706 as filed Dec. 5, 2007.

STATEMENT REGARDING FEDERALLY SPONSORED RESEARCH

Not applicable.

NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND ON THE INVENTION

1. Field of the Invention

The present invention relates generally to cans, and more particularly, to pop-top cans having a partially removable portion that lifts upward away from the associated can.

2. Description of the Related Art

Pop-top cans are popular containers for a variety of food products and beverages. The vast majority of canned beverages such as, for example, soft drinks, beer, juices, and the like, are opened via a top-pop opening in the top of the can Typical pop-top cans include a tab riveted to a top of a cylindrical can, most often near the center of the top. As the tab is pulled upward on one end, the opposing end is directed downward towards a scored region of the top of the can. When enough force is exerted by the tab against the scored region, the scored region begins to separate from the rest of the top of the can, thereby creating an opening through which contained beverages may escape.

Although there has been great commercial success, there are significant drawbacks to the current pop-top can.

The tabs on most pop-top cans are substantially flat against the top of the can. Lifting the tab upward and away from the top of the can be an arduous task for individuals with arthritis, longer fingernails, thick or larger fingers, and the like. The prior art is full of devices designed to assist individuals with lifting such pop-top tabs. See, for example, U.S. Pat. No. 4,524,646 to Kimberlin, Jr., and U.S. Pat. No. 5,555,778 to Otters et al.

Typically, the above-described scored region is directed downward, into the can; potentially into direct contact with the container beverage or foodstuff. For some individuals, directing a non-sterile scored region into the container beverage or foodstuff is unsanitary and unhealthy.

Variations have been put forth in an attempt to overcome the aforementioned disadvantages. Completely removable pull-tabs were once commercially available. See, for example, U.S. Pat. No. 3,285,467 to Moran, and U.S. Pat. No. 3,563,199 to Wolfe. Such variations on the pop-top were not desirable; however, as the removable pull tab and attached scored regions often became improperly-disposed litter, were choking hazards, and had severed edges that could cause cuts to individuals.

Thus, what is a desired is a pop-top can that can safely be opened by lifting a region of the top of the can in an upward direction.

SUMMARY

The various exemplary embodiments herein include a pop-top for a lid, wherein the pop-top is comprised of a lid, a partially detachable portion of the lid outlined via a score line, a puncturing means connected to the lid and adjacent to the partially detachable portion, and an opening means attached to the partially detachable portion. The opening means is comprised of a hub, one or more spokes connected to the hub, a ridge connected to the one or more spokes, a lip connected to the ridge, an arm connected to the ridge and extending away from the hub.

The various exemplary embodiments of the present invention further include a method of opening a can. The can is comprised of a lid having a partially detachable portion of the lid outlined via a score line, a puncturing means connected to the lid and adjacent to the partially detachable portion, and an opening means attached to the partially detachable portion. The opening means is comprised of a hub, a ridge connected to the hub, a lip connected to the ridge, and an arm connected to the ridge and extending away from the hub. The arm is positioned to be adjacent to or covering the puncturing means. Then the arm is moved over and past the puncturing means thereby driving the puncturing means to move in a downward direction towards the inside of the can and creating a slight opening in the score line between the partially detachable portion and the lid. Next the ridge and lip enter the slight opening. The ridge and lip are then moved further into the slight opening to unseal the score line. Next the partially detachable portion is hinged upward to reveal an opening in the lid.

The various exemplary embodiments herein include a pop-top for a lid, wherein the pop-top is comprised of a lid, a partially detachable portion of the lid outlined via a score line, a puncturing means connected to the lid and adjacent to the partially detachable portion, and an opening means attached to the partially detachable portion. The opening means is comprised of a hub, a ridge connected to the hub, a lip connected to the ridge, and an arm connected to the ridge and extending away from the hub.

BRIEF DESCRIPTION OF THE DRAWINGS

The various exemplary embodiments of the present invention, which will become more apparent as the description proceeds, are described in the following detailed description in conjunction with the accompanying drawings, in which.

DESCRIPTION OF THE REFERENCED NUMERALS

Figure 3:
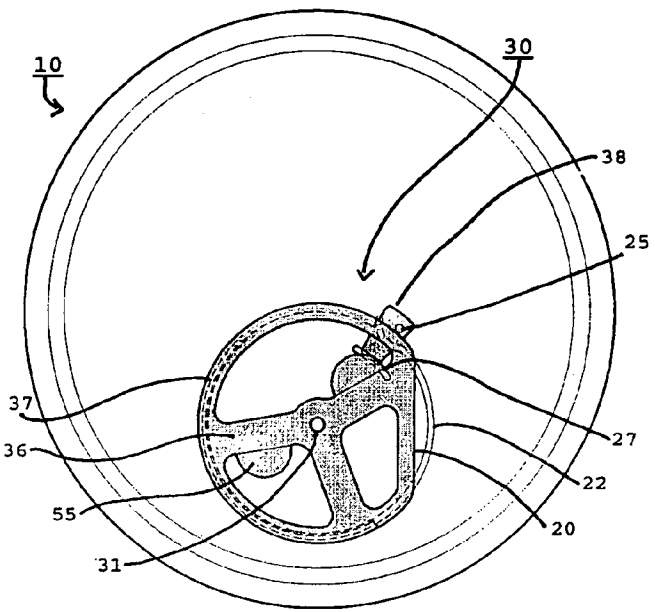
FIG. 3 is a top-view illustration of the exemplary embodiment opening means of FIG. 2 attached to the lid of FIG. 1.

In reference to the drawings, similar reference characters denote similar elements throughout all the drawings. The following is a list of the reference characters and associated element:

10 lid
20 partially detachable portion
22 score line
25 puncturing means
26 lifting means
27 guiding means
30 opening means
31 rivet
35 hub
36 one or more spokes
37 ridge
38 arm
39 lifting ridge
45 bulge
55 finger flaps
60 one or more recessed tracking bumps
65 one or more raised tracking bumps
70 inner track
75 outer walls

DETAILED DESCRIPTION

The drawings show, for purposes of further illustration and understanding, that the various exemplary embodiments of the present invention include a partially detachable portion 20 of a lid 10 of a can (not shown) that is partially separated from the can lid in an upward direction away from an inside of the can.

The various exemplary embodiments of the present invention preferably are located on a topside, that is, for example, the lid, of a can. In a preferred embodiment the can is comprised of aluminum, steel, or other metal or alloy.

A partially detachable portion of the lid is defined by a score line 22. The score line may be of any desired shape. In a preferred embodiment, the score line is curved and substantially circular, oblong, oval, or tear-drop in shape, wherein a narrower portion of the partially detachable portion, if present, is close to a center of the lid.

In various exemplary embodiments, an opening means 30 is adjacent to the partially detachable portion. In a preferred embodiment, the opening means is attached to the partially detachable portion. Attachment to the partially detachable portion may be conducted via a rivet, adhesive, and the like.

The exemplary opening means illustrated in the Figures is substantially circular in shape. In an exemplary embodiment, the opening means is comprised of a hub 35, one or more spokes 36, a ridge 37, and an arm 38. The opening means may be comprised of plastic, metal, ceramic, or a combination thereof.

In an exemplary embodiment, a rivet 31 of the lid attaches to the hub of the opening means. The opening means is able to rotate around the rivet. The rivet may be located anywhere on the lid.

In an exemplary embodiment, the hub includes a pawl and catch mechanism on an underside of the hub and adjacent to the lid. Such mechanism may also be known as a ratchet mechanism. In practical operation, as the hub is rotated around the rivet, it may be desired to better ensure that the hub may rotate in a single forward direction; shown in the figures as a clock-wise direction. As the hub is rotated forward around the rivet, the pawl and catch lock, thereby substantially eliminating reverse direction, that is, counter-clockwise movement of the hub around the rivet. Thus, an individual would be less likely to partially open a can and leave the can for an unknowing individual to take. Substantially reducing the reverse direction of the hub will better ensure knowing whether a can has been opened.

Figure 4:
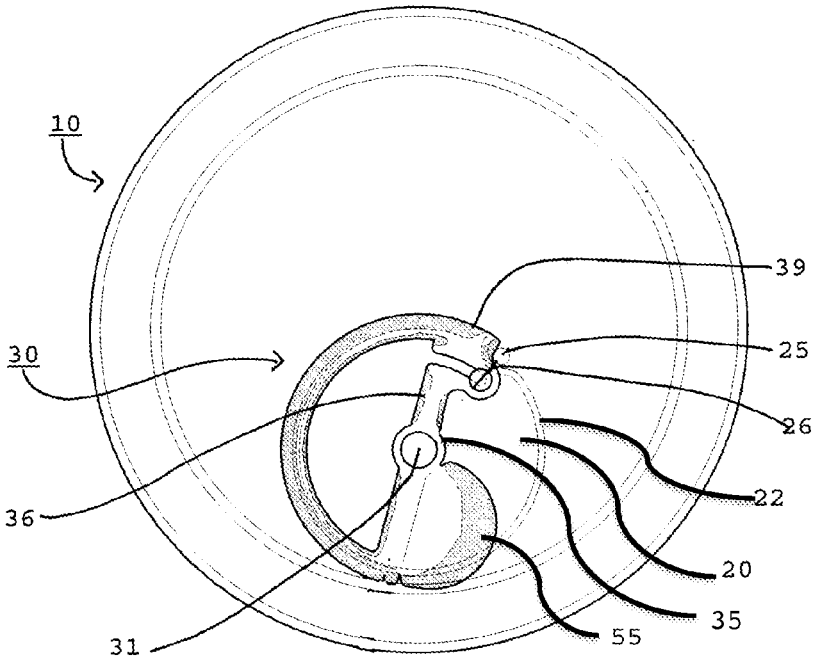
FIG. 4 is a top-view illustration of an exemplary embodiment of an opening means according to the present invention attached to a lid.
Figure 5:
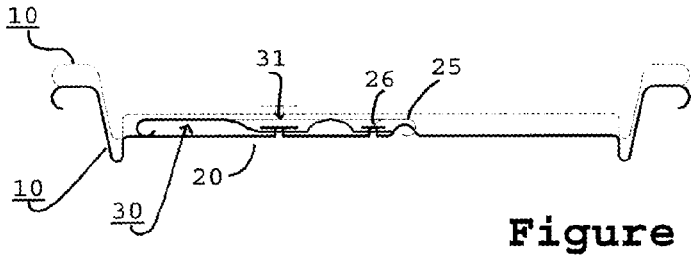
FIG. 5 is a side-view illustration of the exemplary embodiment of FIG. 4 illustrating stacking of lids with the exemplary opening means.
Figure 6:
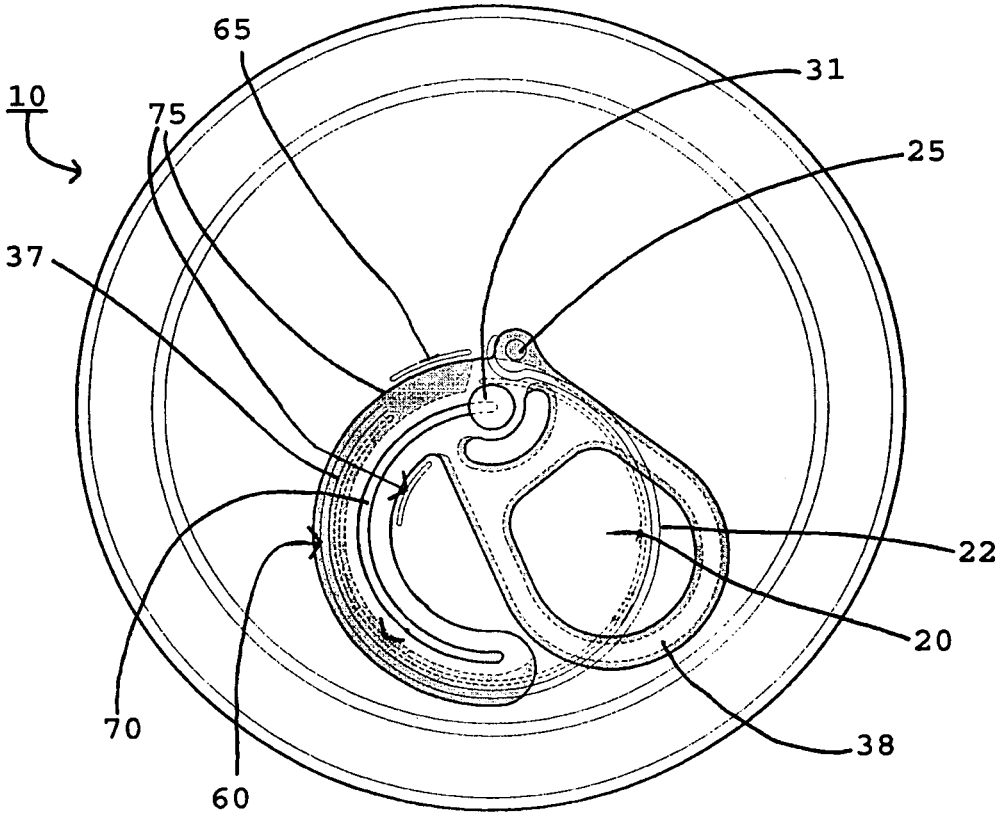
FIG. 6 is a top-view illustration of another exemplary embodiment of an opening means according to the present invention attached to a lid.
Figure 7:
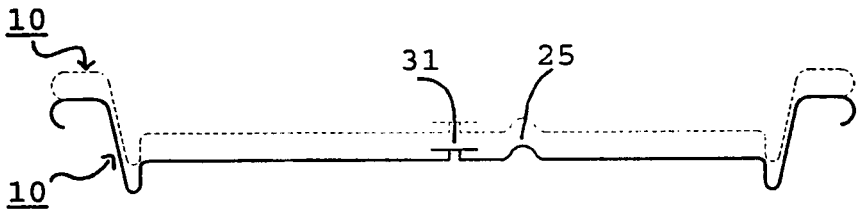
FIG. 7 is a side-view illustration of the exemplary embodiment of FIG. 6 illustrating stacking of lids with the exemplary opening means.
Figure 8:
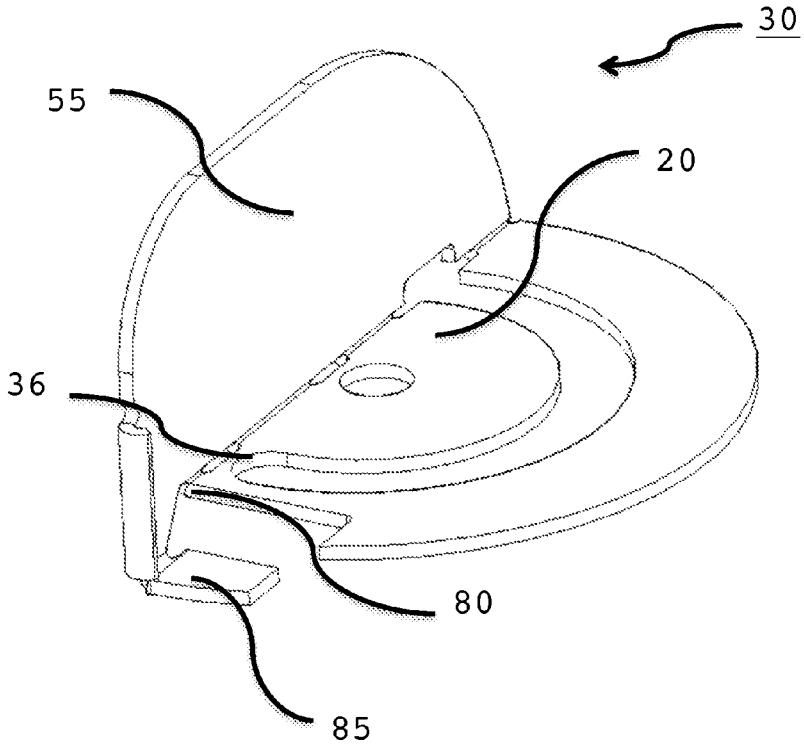
Figure 9:
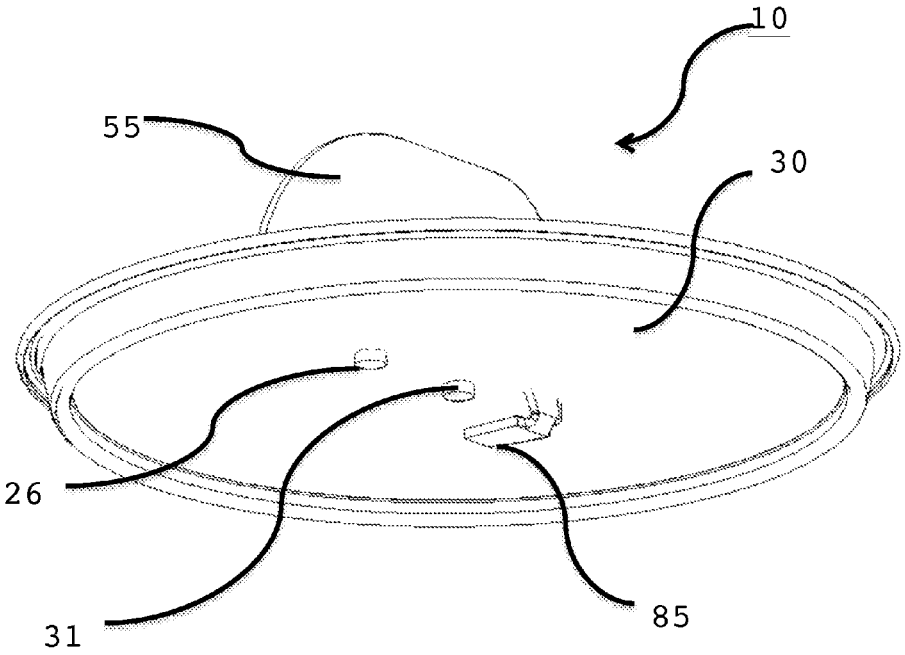

In various exemplary embodiments, one or more spokes connect the hub of the opening means to the ridge. In the illustrated embodiments in FIGS. 2 and 3, three spokes are present. In FIGS. 4 and 5, two spokes are present.

In various exemplary embodiments, the opening means is comprised of a hub, a ridge connected to the hub, a lip connected to the ridge, and an arm or tab connected to the ridge and extending away from the hub.

The ridge exemplified in the figures is semi-circular in shape. However, the ridge may be of any shape as long as it substantially corresponds and/or mirrors the shape of the score line of the partially removable portion.

Figure 2:
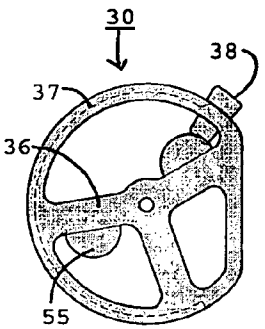
FIG. 2 is a top-view illustration of an opening means according to an exemplary embodiment of the present invention.
Figure 1:
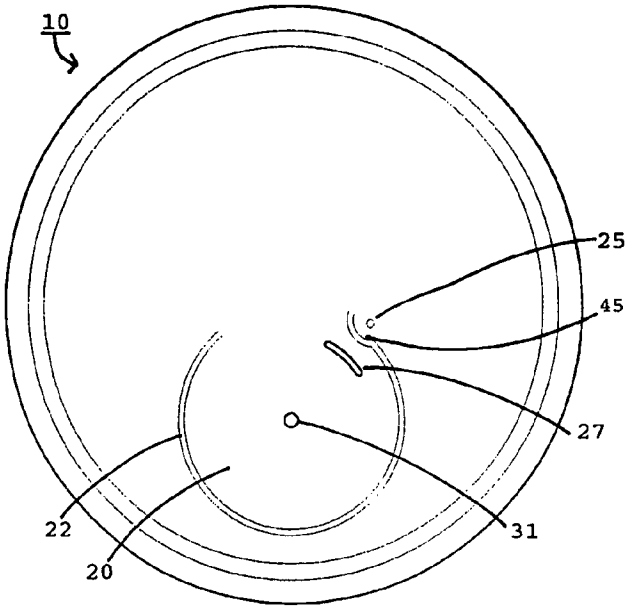
FIG. 1 is a top-view illustration of an exemplary embodiment of a lid in a fully-sealed position having partially detachable portion.

The ridge preferably includes an arm and a lip. In FIGS. 2 and 3, the arm preferably extends away from the ridge and in a direction towards the puncturing means.

Adjacent to the partially detachable portion on the lid is a puncturing means 25. In various exemplary embodiments, the puncturing means appears as a small bump or pimple on the lid of the can. It is preferred that the puncturing means not be on the partially detachable portion.

When the partially detachable portion is in a closed position, that is, the score line has not been broken and the lid is intact, the arm is adjacent to or covering the puncturing means. An underside of the arm adjacent to the lid may include a concave section (not shown) in which the puncturing means may be surrounded. Thus, in the embodiment in which the arm covers the puncturing means, the arm protects the puncturing means.

As the arm is moved over the puncturing means, the arm directs the puncturing means to move in a downward direction towards the inside of the associated can. As the puncturing means moves downward, the score line unseals the partially detachable portion from the lid revealing a slight opening. As the score line unseals, the lip of the ridge enters the slight opening. Once the lip of the ridge compromises the edge of the partially detached portion, the ridge and lip may be directed in the direction of the unbroken aspects of the score line to unseal the remainder of the score line, thereby separating the partially detachable portion from the lid.

In another exemplary embodiment, not shown in the figures, the arm may be in the form of a lever means. In the exemplary embodiment wherein the arm is a lever means, the arm may be lifted away from the lid and moved in a direction towards, for example, the hub. Such movement of the arm may drive a puncturing means downward, thereby exposing a slight opening between the score line and the partially detachable portion from the lid. As described above, as the score line unseals, the lip of the ridge enters the slight opening. Once the lip of the ridge compromises the edge of the partially detached portion, the ridge and lip may be directed in the direction of the unbroken aspects of the score line to unseal the remainder of the score line, thereby separating the partially detachable portion from the lid.

In another exemplary embodiment, the arm may be in the form of a push button means. In this embodiment, not shown in the drawings, the arm may be pushed inward towards the lid thereby pushing the puncturing means inward towards the lid. Once more, such action should expose a slight opening between the score line and the partially detachable portion from the lid. As described above, as the score line unseals, the lip of the ridge enters the slight opening. Once the lip of the ridge compromises the edge of the partially detached portion, the ridge and lip may be directed in the direction of the unbroken aspects of the score line to unseal the remainder of the score line, thereby separating the partially detachable portion from the lid.

In another exemplary embodiment, the ridge includes an inner track 70 that is substantially similar in width as an inner diameter of the rivet. One or more raised tracking bumps 65 may be substantially adjacent to outer walls 75 of the ridge. The one or more raised tracking bumps may assist in substantially maintaining a movement of the ridge as it is moved about the rivet to unseal the score line. In addition to the one or more raised tracking bumps, there may also be one or more recessed tracking bumps 6o for assisting in maintaining movement of the ridge as it is moved about the rivet.

In exemplary embodiments, a slight bulge 45 of the lid surrounds the puncturing means. The slight bulge in preferred embodiments allows for more efficient unsealing of the score line with substantially less jeopardy to the structural integrity of the lid and partially detachable portion. That is, the bulge may allow for the unsealing of the score line without tearing the lid or the partially detachable portion.

As the lip unseals the score line, the lip may substantially surface an edge of the partially detachable means to protect an individual from being cut or injured by the sharpness of the edge.

Once the score line is substantially unsealed, the partially detachable portion may be lifted upward and hinged away from the opening created in the lid. The contents of the lid may then be accessed through the opening.

In another exemplary embodiment, a lifting means 26 is present on partially detachable portion 20. A lifting ridge 39 is substantially adjacent to the lifting means. Preferably, the lifting ridge is adjacent to at least two sides of the lifting means.

The lifting means may be in the form of a shaft with a head that extends outwardly from the shaft. It is preferred that the lifting ridge be substantially adjacent to the shaft and on an underside of the head of the lifting means. Further, in a preferred embodiment, the lifting ridge includes at least a slight incline along a length of the lifting ridge.

Thus, as the arm is moved over the puncturing means, the arm directs the puncturing means to move in a downward direction towards the inside of the associated can. Simultaneously, the lifting ridge moves in a similar direction as the arm moves, and the lifting ridge moves around the lifting means. The incline of the lifting ridge substantially maintains the position of the lifting means and/or moves the lifting means and connected partially detachable portion in a slight upward direction away from the top of the lid. As the puncturing means moves downward and the lifting means maintains position or moves upward with the partially detachable portion, the score line unseals the partially detachable portion from the lid revealing a slight opening. As the score line unseals, the partially detached portion substantially separates from the lid.

The number of finger flaps, if present, may vary. Such one or more finger flaps, if present, may be stationary in an upward direction away from the lid as illustrated in the aforementioned figures. In another exemplary embodiment, the finger flaps may be hinged such that the finger flaps may be flipped upward away from the lid or downward towards the lid. Hinging the finger flaps may allow for better packing and delivering of a can having the present invention. For example, the finger flaps may be directed downward when manufactured and forwarded to consumers. As an individual wishes to open the lid; however, one or more finger flaps may be flipped upward for easier grasping of the opening means by an individual.

One or more guiding means 27 may be present on the lid to better ensure proper movement of the opening means as the partially detachable portion is separated from the lid. As illustrated in the drawings, the one or more guiding means may be shape to substantially match the lip of the ridge.

Although the one or more guiding means is illustrated to be on the partially detachable portion, the one or more guiding means may be on the lid.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. A pop-top lid, the pop-top comprised of:

a lid comprising a partially detachable portion defined in the lid by a semi-circular score line and having a corresponding peripheral edge;

a puncturing means connected to the lid and adjacent to the partially detachable portion wherein the puncturing means comprises at least one protrusion in the lid; and an opening means comprising a tab having a top and bottom side and a peripheral edge wherein the tab is pivotally mounted to the lid at a fixed pivot point adjacent to the partially detachable portion, the tab being comprised of a lifting means wherein the lifting means has a cross-section that is c-shaped to form a lifting ridge along the periphery of the tab;

wherein engagement between the lifting means and the protrusion of the puncturing means fractures the score line and opens the partially detachable portion of the lid when rotating the tab about the pivot point in an opening direction.

2. The pop-top according to claim 1, wherein further rotation of the lifting means in an opening direction engages the lifting ridge with the corresponding peripheral edge of the partially detachable portion of the lid as the score line is sheared apart while rotating the tab.

3. The pop-top according to claim 2, wherein the tab is secured to the lid by a rivet extending through an aperture in the tab.

4. The pop-top according to claim 3, further comprising a guiding means adjacent to or on the partially detachable portion.

5. The pop-top according to claim 1, further comprising a pawl and catch mechanism on the bottom side of the tab and adjacent to the lid.

6. The pop-top according to claim 3, wherein the lifting ridge is slightly inclined.

7. A pop-top lid, the pop-top comprised of:

a lid comprising a partially detachable portion defined in the lid by a semi-circular score line and having a corresponding semi-circular peripheral edge;

a puncturing means connected to the lid and adjacent to the partially detachable portion wherein the puncturing means comprises at least one protrusion in the lid; and an opening means comprising a tab having a top and bottom side and a peripheral edge wherein the tab is pivotally mounted to the lid at a fixed pivot point adjacent to the partially detachable portion, the tab being comprised of a lifting means wherein the lifting means has a cross-section that is c-shaped to form a lifting ridge along the periphery of the tab;

a ridge connected to the hub and an inner track in the lifting ridge which surrounds a rivet attached to a lid such that the inner track allows movement of the lifting ridge about the rivet in at least one of two directions wherein engagement between the lifting means and the protrusion of the puncturing means fractures the score line and opens the partially detachable portion of the lid when rotating the tab about the pivot point in an opening direction.

8. The pop-top according to claim 7, further comprising one or more raised tracking bumps substantially adjacent to the outer walls of the lifting ridge, one or more recessed tracking bumps, or a combination thereof for assisting in maintaining proper movement of the lifting ridge about the rivet.

9. The pop-top according to claim 8, wherein the bottom side of the tab adjacent to the lid may include a concave section in which the puncturing means may be surrounded.

10. A method of opening a can, wherein the can comprises the pop-top lid of claim 1; the method comprising the steps of:

rotating the tab to be adjacent to or covering the puncturing means;

moving the tab over the puncturing means and driving the puncturing means to move a downward direction towards the inside of the can and creating a slight opening in the score line between the partially detachable portion and the lid;

catching the lifting ridge in the slight opening; moving the lifting ridge further into the slight opening to unseal the score line; and hinging the partially detachable portion upward to reveal an opening in the lid.

11. The method according to claim 10, wherein the lifting ridge has a slight incline such that the lifting ridge is substantially adjacent to the lifting means; and as the tab is moved over the puncturing means, the lifting ridge is moved in the direction the tab moves around the lifting means such that the incline of the lifting ridge substantially maintains the position of the lifting means and/or moves the lifting means and connected partially detachable portion in a slight upward direction away from the top of the lid.

12. The method according to claim 10, wherein the lifting ridge of the opening means is comprised of an inner track that is substantially similar in width as a diameter of an inner diameter of the rivet, wherein the inner track assists in substantially maintaining a movement of the lifting ridge as it is moved about the rivet to unseal the score line.

* * * * *